US009905117B2

(12) United States Patent
Estes et al.

(10) Patent No.: US 9,905,117 B2
(45) Date of Patent: Feb. 27, 2018

(54) SYSTEMS AND METHODS FOR NOTIFYING LAW ENFORCEMENT OFFICERS OF ARMED INTRUDER SITUATIONS

(71) Applicant: Guard911 LLC, Collinsville, IL (US)

(72) Inventors: Brian Lee Estes, Columbia, IL (US); Nathan John McVicker, Columbia, IL (US); Thomas Michel Swip, Jr., Columbia, IL (US); Michael Ray Snyders, Springfield, IL (US); Charlton Martin, Salem, AL (US)

(73) Assignee: Guard911 LLC, Collinsville, IL (US)

( * ) Notice: Subject to any disclaimer, the term of this patent is extended or adjusted under 35 U.S.C. 154(b) by 0 days.

(21) Appl. No.: 14/597,087

(22) Filed: Jan. 14, 2015

(65) Prior Publication Data

US 2015/0199896 A1 Jul. 16, 2015

Related U.S. Application Data

(60) Provisional application No. 61/927,342, filed on Jan. 14, 2014.

(51) Int. Cl.

| | |
|---|---|
| ***G08B 27/00*** | (2006.01) |
| ***G08B 25/01*** | (2006.01) |
| *G08B 13/00* | (2006.01) |
| *G08B 21/22* | (2006.01) |

(52) U.S. Cl.

CPC ..... *G08B 27/001* (2013.01); *G08B 25/016* (2013.01); *G08B 13/00* (2013.01); *G08B 21/22* (2013.01)

(58) Field of Classification Search

CPC .... G08B 25/016; G08B 27/001; G08B 13/00; G08B 13/19641; G08B 13/19645; G08B 15/001; G08B 21/0269; G08B 21/0288; G08B 21/22; G08B 25/005; G08B 25/006; G08B 25/008; G08B 25/012; G08B 25/14

USPC .... 340/541, 7.59, 7.58, 6.1, 7.2, 531, 539.1, 340/571

See application file for complete search history.

(56) References Cited

U.S. PATENT DOCUMENTS

| | | | | |
|---|---|---|---|---|
| 5,305,370 A * | 4/1994 | Kearns | H04M 11/04 | 379/38 |
| 7,468,663 B1 * | 12/2008 | Rufolo, Jr. | G08B 13/19641 | 340/540 |
| 2005/0132414 A1 * | 6/2005 | Bentley | G08B 13/19606 | 725/105 |

(Continued)

*Primary Examiner* — Daniel Previl

(74) *Attorney, Agent, or Firm* — Milligan PC LLO

(57) ABSTRACT

A computer-implemented method executed by one or more computer servers includes receiving a notification from a communication device, determining whether one or more other communication devices are within a stationary geofence, and in response to the notification, sending an emergency alert to the other communication devices determined to be within the stationary geofence. The computer-implemented method may further include receiving an acknowledgement of the emergency alert from at least one of the other communication devices determined to be within the stationary geofence and/or sending data indicating an approximate location of the communication device and an associated tolerance of the approximate location. Other example computer-implemented methods, communication devices including software applications, and systems are also disclosed.

13 Claims, 8 Drawing Sheets

(56) References Cited

U.S. PATENT DOCUMENTS

| | | | | |
|---|---|---|---|---|
| 2011/0029009 | A1* | 2/2011 | Dietl | A61B 17/1322<br>606/203 |
| 2011/0256881 | A1* | 10/2011 | Huang | G01S 5/0257<br>455/456.1 |
| 2014/0344404 | A1* | 11/2014 | Layson | G06F 3/0484<br>709/217 |

* cited by examiner

SYSTEMS AND METHODS FOR NOTIFYING LAW ENFORCEMENT OFFICERS OF ARMED INTRUDER SITUATIONS

CROSS-REFERENCE TO RELATED APPLICATION

This application claims the benefit of U.S. Provisional Application No. 61/927,342 filed Jan. 14, 2014. The entire disclosure of the above application is incorporated herein by reference.

FIELD

The present disclosure relates to systems and methods for notifying law enforcement officers (LEOs) of armed intruder situations.

BACKGROUND

This section provides background information related to the present disclosure which is not necessarily prior art.

During an armed intruder situation, an individual may notify emergency services (e.g., by dialing 911). Emergency services then contact an appropriate agency (e.g., a police station) at which time the agency contacts various LEOs who may then respond (if available) to the armed intruder situation.

Sometimes an individual may develop a specific network of friends, neighbors, family members, etc. that are contacted by an assistance system when the individual sends a notification indicating an emergency. In some instances, specific members of the network may be contacted depending on the type of emergency, the location of the emergency, etc.

SUMMARY

This section provides a general summary of the disclosure, and is not a comprehensive disclosure of its full scope or all of its features.

According to one aspect of the present disclosure, a computer-implemented method executed by one or more computer servers is disclosed. The method includes receiving a notification from a first communication device of a first plurality of communication devices. The notification indicates an armed intruder within a first stationary geofence. The method further includes determining whether one or more law enforcement officer (LEO) communication devices are within a second stationary geofence different than the first stationary geofence, and in response to the notification, sending an emergency alert to the one or more LEO communication devices determined to be within the second stationary geofence.

According to yet another aspect of the present disclosure, an LEO communication device includes memory, one or more processors, a user interface, and a software application stored in the memory for execution by the one or more processors. The software application is configured to receive an emergency alert indicating an armed intruder within a first stationary geofence if the LEO communication devices is located within a second stationary geofence different than the first stationary geofence, receive user input acknowledging the emergency alert and identifying whether the acknowledging LEO is in uniform, and send the received user input acknowledging the emergency alert and identifying whether the acknowledging LEO is in uniform.

According to another aspect of the present disclosure, a communication device includes memory, one or more processors, a user interface, and a software application stored in the memory for execution by the one or more processors. The software application is configured to send a notification indicating an armed intruder within a stationary geofence to a remote server in response to user input when the communication device is within the stationary geofence and not send the notification to the remote server in response to the user input when the communication device is outside the stationary geofence.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Figure 1:
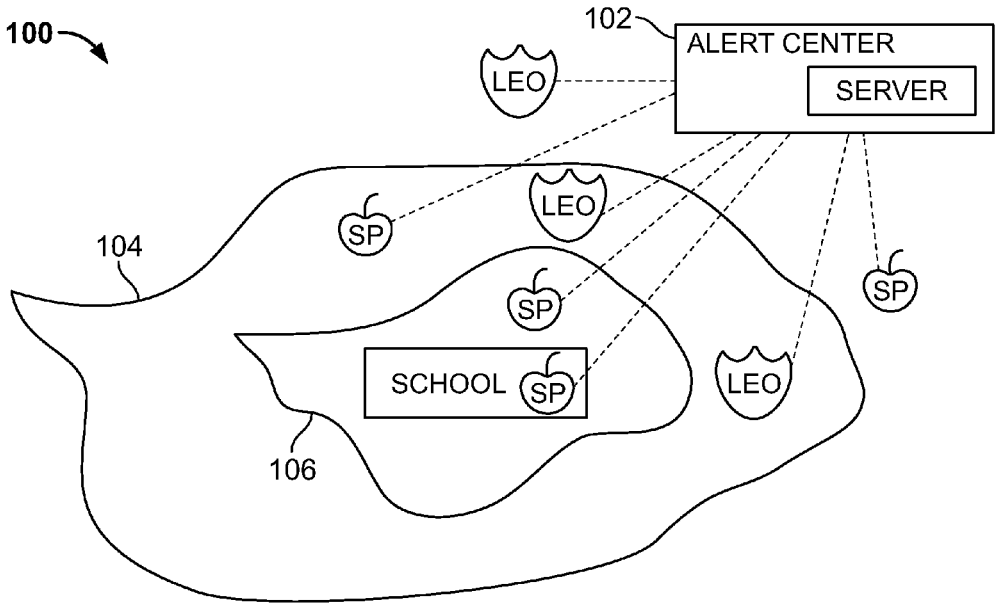
FIG. 1 is a diagram of a system including an alert center and two stationary geofences encompassing a school according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A system for notifying one or more law enforcement officers (LEOs) of an armed intruder by a school personnel according to one example embodiment of the present disclosure is illustrated in FIG. 1 and indicated generally by reference number 100. As shown in FIG. 1, the system 100 includes an alert center 102, stationary geofences 104, 106, multiple LEOs, and multiple school personnel SP. In the example of FIG. 1, the stationary geofence 104 is different than the stationary geofences 106. For example, the stationary geofence 104 encompasses the stationary geofence 106 and both geofences 104, 106 encompass a school.

As shown in FIG. 1, two LEOs are within the stationary geofence 104 and one LEO is outside the stationary geofence 104. Additionally, two school personnel SP are within the stationary geofence 106 and two school personnel SP are outside the stationary geofence 106.

The alert center 102 is configured to communicate with the LEOs and the school personnel SP using a wired and/or wireless network(s). For example, each of the LEOs and each of the school personnel SP may have a communication device configured to communicate with the alert center 102. Each of the LEO communication devices includes a LEO software application and each of the school personnel communication devices includes a school personnel software application.

The alert center 102 may receive a notification from any one of the school personnel SP (e.g., the school personnel's communication device) indicating an armed intruder within the stationary geofence 106. The alert center 102 may further determine whether any LEOs (e.g., the LEOs' communication device) are within the stationary geofence 104 and, in response to the notification, send (e.g., provide, transmit, etc.) an emergency alert to each of the LEOs determined to be within the stationary geofence 104.

Figure 5:
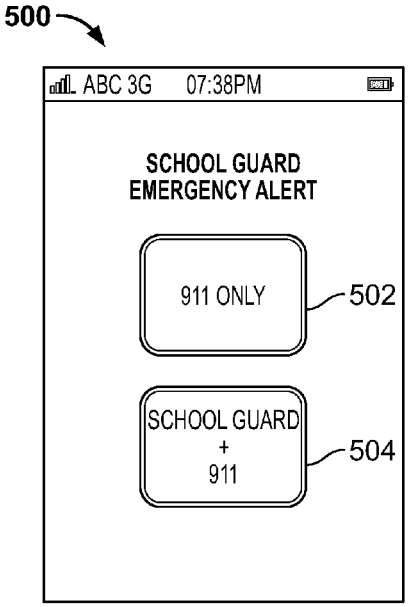
FIG. 5 is a screen shot of a school personnel software application having user inputs for sending a notification indicating an emergency according to yet another example embodiment.
Figure 6:
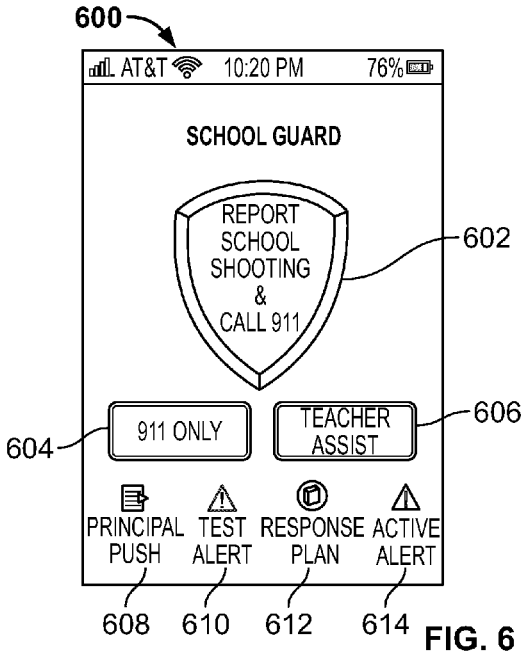
FIG. 6 is a screen shot of a school personnel software application having user inputs for sending a notification indicating an emergency and activating other software application features according to another example embodiment.

For example, FIGS. 5 and 6 illustrate example screen shots 500 and 600, respectively, of a school personnel software application. The software application screen shot 500 of FIG. 5 includes a selectable input 502 to only notify (e.g., call, etc.) 911, and another selectable input 504 to notify the alert center 102 (and/or another suitable management system, etc.) and 911.

The software application screen shot 600 of FIG. 6 includes various selectable inputs. For example, the inputs include an input 602 for sending (e.g., providing, etc.) a notification indicating a school shooting and calling 911 (or another emergency service provider), an input 604 for only calling 911, and an input 606 for a teacher assist option. Additionally, the screen shot 600 includes an input 608 allowing a principal (or another administrator) to access a messaging system, an input 610 allowing a user to test the software application, an input 612 to access a response plan, and an input 614 to view an active alert. The inputs and their functionalities are further explained below.

Referring back to FIG. 1, the alert center 102 may send the emergency alert to any LEOs determined to be within the stationary geofence 104 irrespective of whether these LEOs are on-duty, off-duty, retired, etc. By determining whether any LEOs are within the stationary geofence 104 and then sending the emergency alert to the LEOs within the stationary geofence 104, the LEO response time to an armed intruder situation may be markedly reduced.

For example, if an LEO is determined to be within the stationary geofence 104 based on the location of the LEO's communication device, the alert center 102 sends an emergency alert to notify the LEO that an armed intruder situation is occurring relatively close to the LEO. In turn, the LEO may approach the school thereby reducing the response time. For example, this response time may be reduced from an average time of about eighteen minutes for on-duty LEOs following typical protocol.

Figure 16:
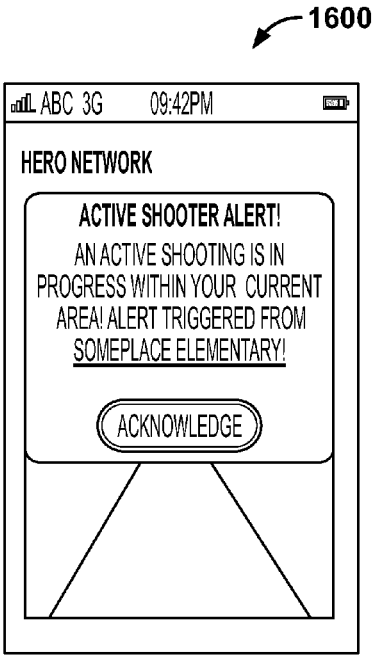
FIG. 16 is a screen shot of a LEO software application requesting the LEO to acknowledge an emergency alert according to yet another example embodiment.

In some embodiments, the alert center 102 may receive an acknowledgement of the emergency alert from any LEO determined to be within the stationary geofence 104. This acknowledgement confirms the LEO received the emergency alert and intends to approach the school. For example, an LEO may select an input on the LEO software application to send the acknowledgement to the alert center 102 indicating receipt of the emergency alert. FIG. 16 illustrates one example screen shot 1600 of an LEO software application including the emergency alert indicating an active shooting situation, and a selectable input to acknowledge the alert.

In some examples, this acknowledgement may include an indication of whether the acknowledging LEO is in uniform. In other examples, the acknowledgement may include an indication of whether the acknowledging LEO is in uniform or not in uniform. For example, an LEO may be off-duty and driving through the stationary geofence 104 of FIG. 1 when he/she receives an emergency alert indicating an armed intruder situation nearby. In response, the off-duty LEO may acknowledge the emergency alert and indicate he/she is not in uniform (e.g., in plain clothes, etc.). Additionally, another LEO (not shown in FIG. 1) may be on-duty and walking through the stationary geofence 106 when he/she receives the emergency alert indicating the same armed intruder situation. In response, the on-duty LEO may acknowledge the emergency alert and indicate he/she is in uniform (e.g., a police issued uniform, military issued uniform, etc.).

Figure 17:
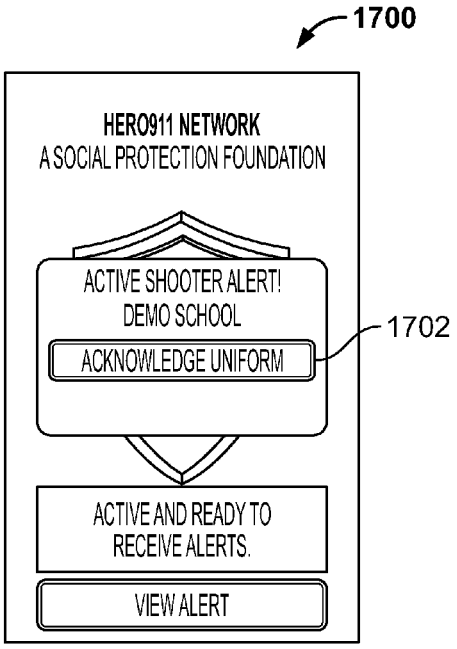
FIG. 17 is a screen shot of a LEO software application requesting the LEO to acknowledge an emergency alert and indicate whether the LEO is in uniform according to another example embodiment.
Figure 18:
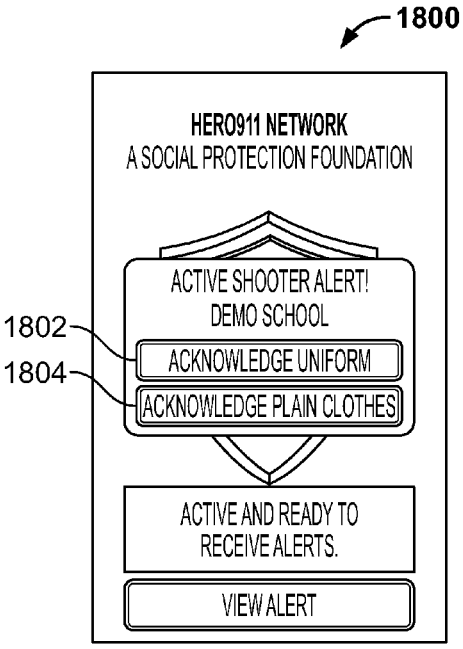
FIG. 18 is a screen shot of a LEO software application requesting the LEO to acknowledge an emergency alert and indicate whether the LEO is in uniform or in plain clothes according to yet another example embodiment.

For example, FIGS. 17 and 18 illustrate example screen shots 1700 and 1800, respectively, of an LEO software application. The software application screen shot 1700 of FIG. 17 includes a selectable input 1702 to acknowledge the alert and indicate the acknowledging LEO is in uniform. The software application screen shot 1800 of FIG. 18 includes a selectable input 1802 to acknowledge the alert and indicate the acknowledging LEO is in uniform (similar to the input 1702 of FIG. 17) and another selectable input 1804 to acknowledge the alert and indicate the acknowledging LEO is in plain clothes (e.g., not in uniform).

Figure 19:
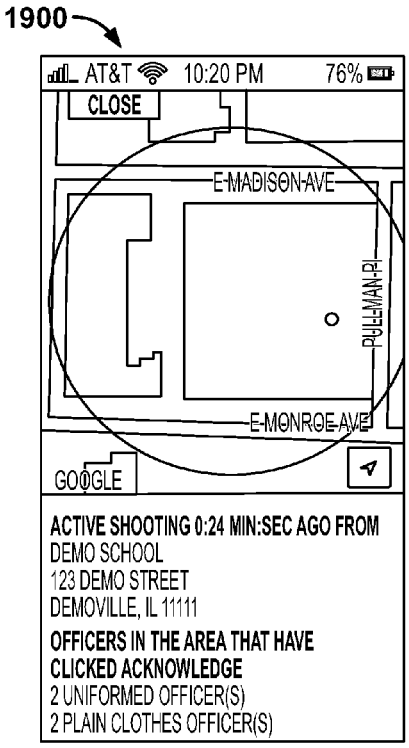
FIG. 19 is a screen shot of a LEO software application displaying a map and address of a school, and a number of other uniformed and/or plain clothed LEOs who acknowledged the emergency alert according to another example embodiment.

In some example embodiments, the alert center 102 of FIG. 1 may send to each LEO (e.g., each LEO communication device) that acknowledged the emergency alert a quantity indicating the number of LEOs in uniform that acknowledged the emergency alert and/or a quantity indicating the number of LEOs not in uniform that acknowledged the emergency alert. In this way, each acknowledging (and therefore responding) LEO is aware of how many other responding uniformed LEOs and/or responding non-uniformed LEOs are at and/or approaching the school. For example, FIG. 19 illustrates an example screen shot 1900 of an LEO software application showing two LEOs in uniform acknowledged the emergency alert and two LEOs in plain clothes acknowledged the emergency alert. Additionally, the screen shot 1900 includes a map, the time (e.g., 24 seconds) elapsed since the initial notification was sent by a school personnel SP, and the address of the school.

Additionally and/or alternatively, the alert center 102 of FIG. 1 may send to each LEO communication device that acknowledged the emergency alert data indicating a location of the other acknowledging LEO communication devices for LEOs in uniform and/or a location of other acknowledging LEO communication devices for LEOs not in uniform. The LEO software application stored on each LEO communication device may then display a map including the school, an indicator (e.g., a symbol, a color, etc.) for responding uniformed LEOs, and a different indicator for responding non-uniformed LEOs. This location for each LEO may be provided to the responding LEOs continuously, once, periodically (e.g., every five seconds, ten seconds, etc.), etc. As such, the map showing the position of other responding LEOs (and their clothing type) may be updated as desired.

Figure 20:
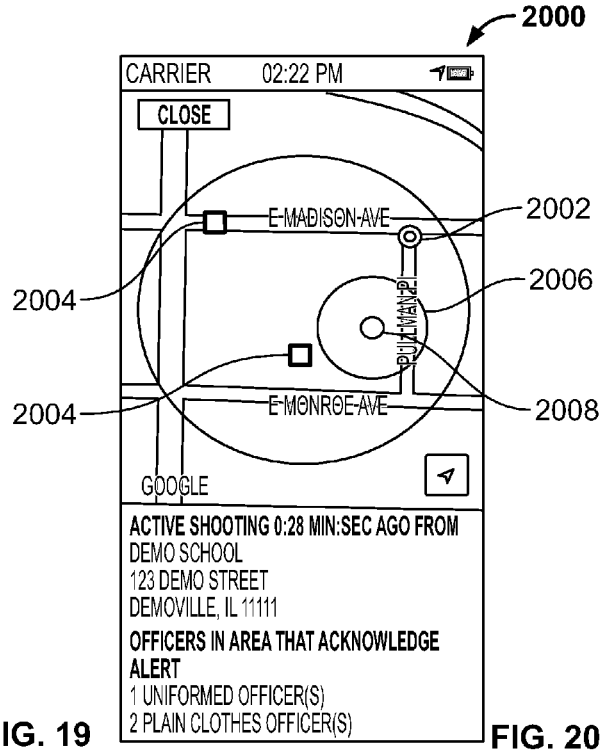
FIG. 20 is a screen shot of a LEO software application displaying a map showing locations of other uniformed and/or plain clothed LEOs who acknowledged the emergency alert according to yet another example embodiment.

For example, FIG. 20 illustrates an example screen shot 2000 of an LEO software application including a map indicating the location of one uniformed LEO (shown as circle 2002) that acknowledged the alert and two plain clothed LEOs (shown as squares 2004) that acknowledged the alert.

Figure 8:
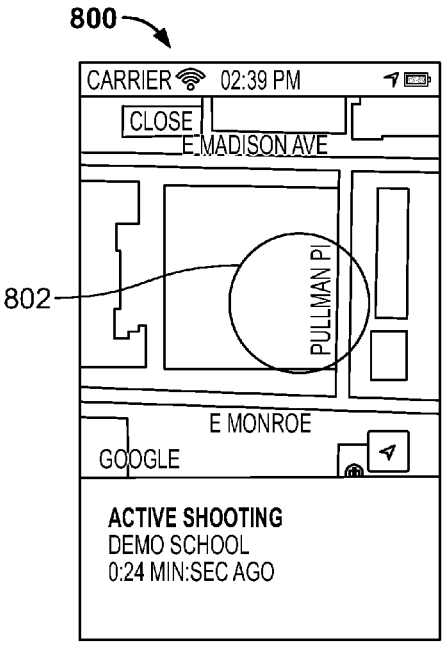
FIG. 8 is a screen shot displaying a map indicating an approximate location of an emergency notification according to another example embodiment.

Referring back to FIG. 1, the alert center 102 may also send to the LEO communication devices that acknowledged the emergency alert and/or one or more of the school personnel communication devices an approximate location of the particular school personnel SP communication device that initially sent the notification of the armed intruder situation. For example, FIG. 8 illustrates a screen shot 800 of a communication device displaying an approximate location (e.g., indicated by the circular 802) of the particular school personnel SP communication device that initially sent the notification of the armed intruder situation. Additionally, the screen shot 800 displays the emergency alert ("Active Shooting"), the name of the school involved (e.g., "Demo School"), and the elapsed time (e.g., 24 seconds) since the original notification indicating the school shooting was sent. The screen shot 800 may be displayed on a LEO communication device and/or a school personnel communication device Additionally and/or alternatively, the alert center 102 of FIG. 1 may also send to the LEO and/or school personnel SP communication devices an associated tolerance of the approximate location of the particular school personnel SP communication device that initially sent the notification of the armed intruder situation. This tolerance may represent an area in which the particular school personnel SP communication device may be located. Thus, this associated tolerance may factor in possible errors in the location of the particular school personnel SP communication device that initially sent the notification.

Figure 7:
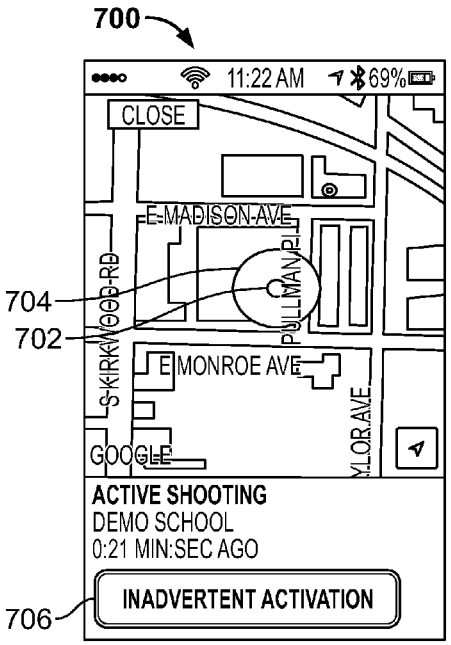
FIG. 7 is a screen shot of a school personnel software application displaying a map indicating an approximate location of an emergency notification according to yet another example embodiment.

The alert center 102 may provide this information by sending data (e.g., map data, etc.) of this approximate location and/or the associated tolerance. The communication device(s) may then display a map including this approximate location and/or the associated tolerance. For example, FIG. 7 illustrates a screen shot 700 of a school personnel software application displaying a map including an approximate location 702 and an associated tolerance 704 encompassing the approximate location 702. Likewise, the screen shot 2000 of FIG. 20 (explained above) displays a map including an approximate location 2006 and an associated tolerance 2008 encompassing the approximate location 2006.

In some cases, the approximate location and/or the associated tolerance may be sent only if the associated tolerance is below a defined threshold. For example, once the approximate location of the particular school personnel SP communication device is determined, the alert center 102 may determine an accuracy range of the location of that device. This accuracy range correlates to the associated tolerance such that as the accuracy range increases, the associated tolerance of the approximate location decreases. As this tolerance decreases, the area in which the communication device may be located decreases. If the accuracy range is satisfactory (e.g., above a defined value), the associated tolerance of the approximate location may be below a defined threshold and thus the approximate location and/or the associated tolerance may be displayed on the communication device(s) as explained herein. In some examples, this defined threshold may be about 50 feet, about 100 feet, about 150 feet, about 250 feet, etc. In other examples, the defined threshold may be less than 50 feet, less than 20 feet, less than 5 feet, less than 3 feet, etc.

The approximate location and/or the accuracy range may be determined by utilizing, for example, global positioning systems (GPS), triangulation systems (e.g., based on signal strength and cellular towers, etc.), low energy positioning systems (e.g., iBeacon™, and/or other suitable systems utilizing low energy), etc. In some examples, the approximate location may be the location of where the initial notification was sent, the current location of the communication device that sent the initial notification, etc. Additionally, the approximate location and/or the accuracy range may be determined (e.g., tested, etc.) once, continuously, periodically, etc. As such, the alert center 102 may not send the approximate location and/or associated tolerance as explained herein until the accuracy is satisfactory.

Figure 9:
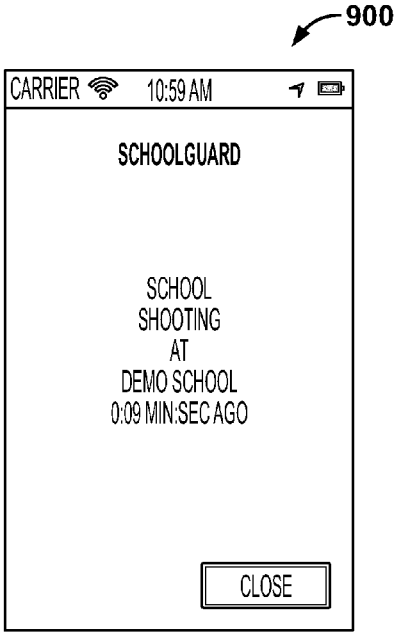
FIG. 9 is a screen shot of a school personnel software application displaying a description of an emergency according to another example embodiment.

If the accuracy is not satisfactory, the LEO software application and/or the school personnel software application may still display information related to the active intruder situation. This information may include, for example, a map, a description of the intruder, possible injuries, an elapsed time since the initial notification, etc. For example, FIG. 9 illustrates a screen shot 900 of a school personnel software application displaying the name (e.g., "Demo School") of the school involved and the elapsed time (e.g., nine seconds) since the original notification indicating the school shooting was sent.

Referring again to FIG. 1, the alert center 102 may determine whether the school personnel SP is within the stationary geofence 106 and then send the emergency alert to identified LEOs only if the school personnel SP is within the stationary geofence 106. For example, the alert center 102 may receive a ping from the school personnel's communication device and/or the LEO's communication device indicating a location of the communication device. In this way, the alert center 102 can restrict sending emergency alerts to LEOs when the school personnel SP is not within the stationary geofence 106 (e.g., not at the school).

Additionally and/or alternatively, the school personnel's communication device may be configured (e.g., via the school personnel software application) to send the notification when it is within the stationary geofence 106 and not send the notification when it is outside the stationary geofence 106. For example, the school personnel SP software application may not display a selectable input if the associated communication device is not within the stationary geofence 106. Thus, in the example of FIG. 1, the two school personnel SP within the stationary geofence 106 may be permitted to send notification(s) while the two school personnel SP outside the stationary geofence 106 may not send notification(s).

In some examples, the alert center 102 may receive another notification indicating a cancellation of the initial notification related to the armed intruder situation. This cancellation notification may be sent by any one of the school personnel SP located within or outside the stationary geofence 106, particular school personnel SP located within or outside the stationary geofence 106, etc. For example, the cancellation notification may be sent by a principal (and/or another suitable administrator), the original notification sender, etc. The example screen shot 700 of FIG. 7 includes a selectable input 706 (e.g., "Inadvertent Activation") for cancelling a notification as explained above.

Figure 21:
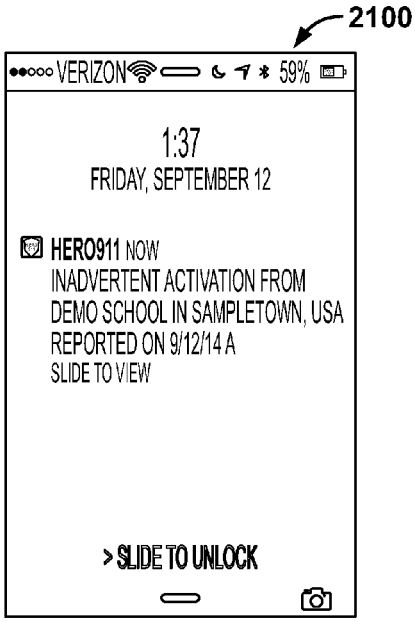
FIG. 21 is a screen shot of a LEO software application displaying a cancellation notification according to another example embodiment.
Figure 22:
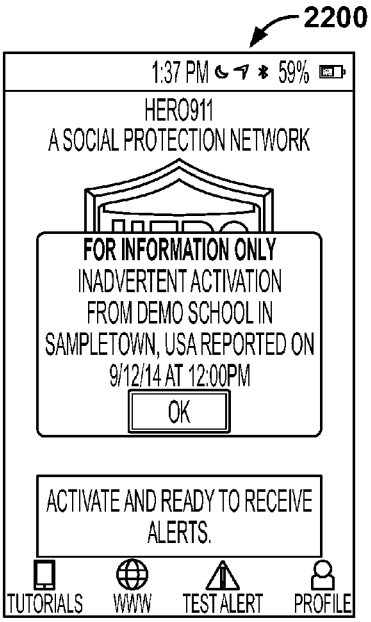
FIG. 22 is a screen shot of a LEO software application displaying a cancellation notification and an input to acknowledge the notification according to yet another example embodiment.

After the alert center 102 receives the cancellation notification, the alert center 102 may send a cancellation alert to the LEO communication devices determined to be within the stationary geofence 104 and/or other school personnel SP communication devices within or outside the stationary geofence 106. For example, FIGS. 21 and 22 illustrate screen shots 2100 and 2200, respectively, of a LEO software application. The screen shot 2100 of FIG. 21 includes a notification indicating an inadvertent activation while the screen shot 2200 of FIG. 22 includes a notification indicating an inadvertent activation and a selectable input to acknowledge this notification.

Referring back to FIG. 1, the alert center 102 may send the emergency alert to school personnel SP outside the stationary geofence 106. For example, the alert center 102 may provide the emergency alert to defined individuals (e.g., principals, deans, presidents, etc.) regardless of where that person is located. The school personnel SP who may receive the emergency alert outside the stationary geofence 106 may be selected and/or modified during the initial setup of the system, after the initial setup, etc.

In some embodiments, the alert center 102 may send an emergency alert to the school personnel SP determined to be within the stationary geofence 106 in response to receiving the notification indicating the armed intruder. For example, if one of the school personnel SP within the stationary geofence 106 notifies the alert center 102 of an armed intruder situation, the alert center 102 can determine that another school personnel SP is within the stationary geofence 106. The alert center 102 can then send an emergency alert to the other school personnel SP indicating that an armed intruder situation may be occurring within the stationary geofence 106.

Additionally and/or alternatively, the alert center 102 may send response plan(s) and/or message(s) to one or more school personnel SP communication devices. In some cases, particular school personnel SP may send (e.g., upload, email, etc.) one or more response plans and/or predefined messages to the alert center 102. These response plans and/or messages may then be stored in memory of the alert center 102. As such, the response plans and predefined messages may be accessible and/or provided to other school personnel SP regardless of their location by selecting appropriate inputs on the school personnel SP software application. In other examples, school personnel SP may create personalized message(s) (e.g., in real time) through the software application and send these messages to the alert center 102. In response, the alert center 102 may provide the personalized message(s) to other school personnel SP, make the personalized message(s) accessible to other school personnel SP, etc.

The messaging options may allow school personnel including for example teachers, principals, administrators, etc. of a particular school to send and receive private messages, alerts, warnings, etc. to other school personnel associated with that school. The messages may relate to armed intruder scenarios (e.g., an active shooter) or to non-armed intruder scenarios including, for example, weather conditions, medical emergencies, student disturbances (e.g., fighting, etc.), student pickup instructions, etc.

Figure 10:
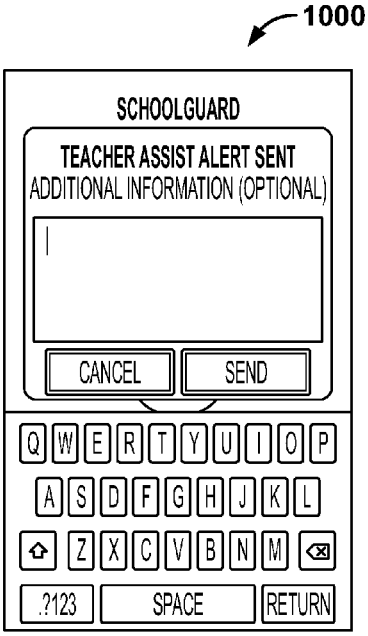
FIGS. 10-14 are screen shots of a school personnel software application having an input for creating a message according to yet another example embodiment.

For example, FIG. 10 illustrates a screen shot 1000 of an input that allows a user (e.g., a teacher or another school personnel) to create a personalized message. The screen shot 1000 may be accessed from the Teacher Assist input 606 of FIG. 6 as noted above. The input of FIG. 10 allows a user to send information related to a general alert, emergency alert, etc. The alerts may include a request for assistance, the user's name, a map of the user's location within a stationary geofence (e.g., the stationary geofence 106 of FIG. 1), etc.

Figure 11:
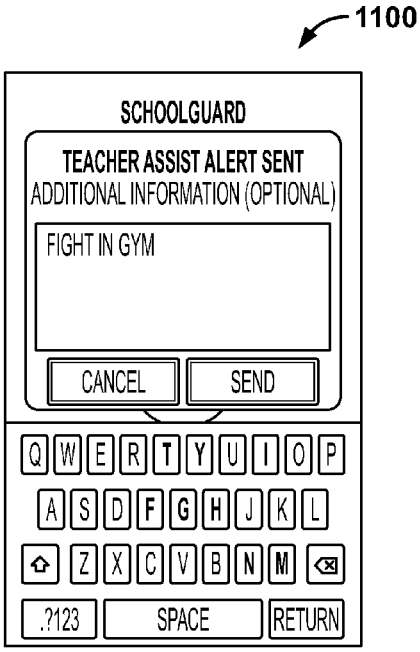
Figure 12:
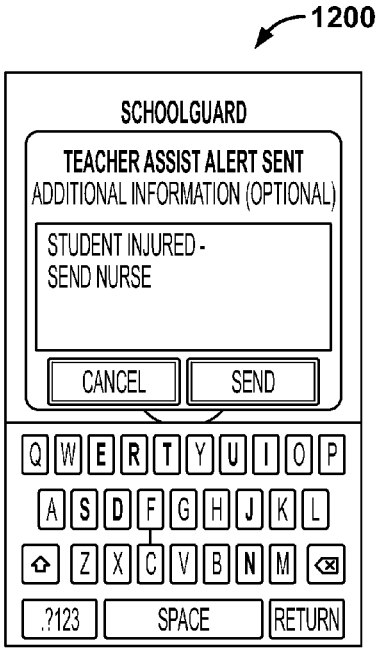

FIGS. 11 and 12 illustrate screen shots 1100 and 1200, respectively, including a personalized message created by a user. The messages may be created for a defined period of time after selecting the Teacher Assist input 606 of FIG. 6 as explained above. In some embodiments, the defined period of time may be about five minutes, more or less than five minutes, or another suitable time. In this way, multiple messages (e.g., updates) may be created without triggering multiple alerts. For example, the screen shot 1100 of FIG. 11 includes the initial message "FIGHT IN GYM" and the screen shot 1200 of FIG. 12 includes a subsequent message "STUDENT INJURED—SEND NURSE."

Figure 13:
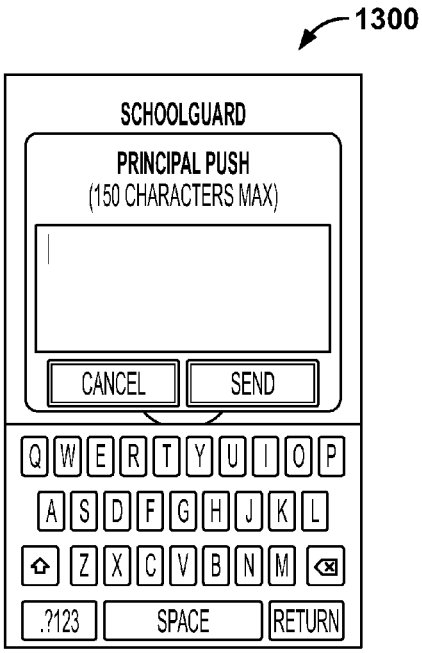

FIG. 13 illustrates a screen shot 1300 similar to the screen shot 1000 of FIG. 10. The screen shot 1300, however, includes an input allowing a principal or another administrator of a particular school to send a message to other school personnel at the same school via the alert center 102. The screen shot 1300 may be accessed from the Principal Push input 608 of FIG. 6 as noted above.

Figure 14:
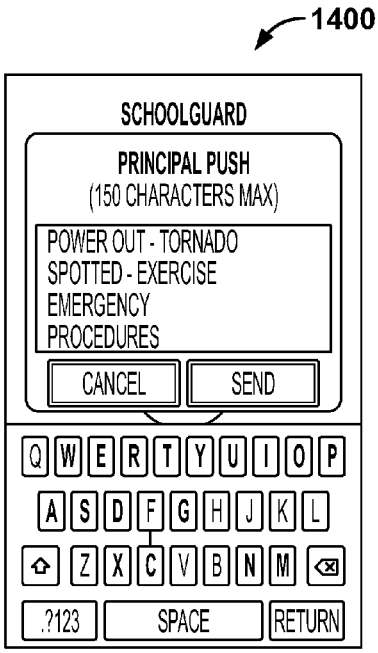

FIG. 14 illustrates a screen shot 1400 including a message created by a principal utilizing the Principal Push input 608 of FIG. 6. As shown in FIG. 14, the screen shot 1400 includes the message "POWER OUT—TORNADO SPOTTED—EXERCISE EMERGENCY PROCEDURES."

Additionally, the school personnel communication device may output an audible sound to notify school personnel that a message and/or a general alert have been received. For example, each communication device may output one distinct audible sound if an alert, a message, etc. is received from a teacher (as explained above with reference to FIGS. 10-12) and output a different distinct audible sound if an alert, a message, etc. is received from a principal (as explained above with reference to FIGS. 13-14). In some embodiments, the two distinct audible sounds may be different than a possible audible warning indicating an armed intruder situation.

Figure 15:
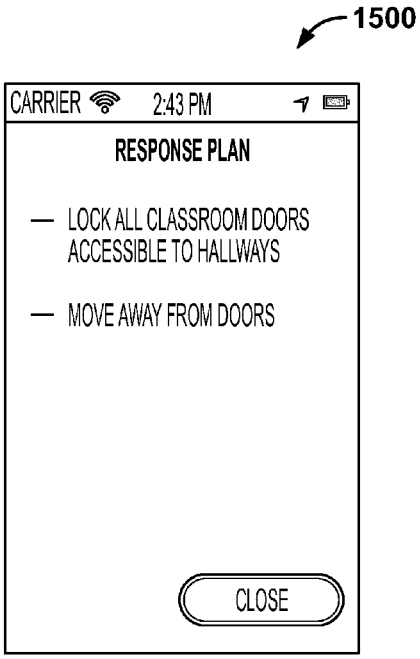
FIG. 15 is a screen shot of a school personnel software application displaying a response plan according to another example embodiment.

As explained above, school personnel may access response plan(s) uploaded and stored on computer servers. The response plans may relate to armed intruder scenarios (e.g., an active shooter). For example, FIG. 15 illustrates a screen shot 1500 of a school personnel communication device displaying a response plan for an armed intruder situation. As shown in FIG. 15, the response plan informs the school personnel to "lock all classroom doors accessible to hallways" and "move away from doors." As such, the response plan may include one or more suggested actions for responding to an emergency alert.

Additionally and/or alternatively, the response plans may relate to non-armed intruder scenarios including, for example, weather, medical emergencies, student disturbances (e.g., fighting, etc.), student pickup instructions, etc. For example, school personnel may receive a message from a principal or another administrator indicating a weather emergency as explained above with reference to FIGS. 13 and 14. In response, school personnel may access an appropriate response plan explaining how to respond to the weather emergency.

The response plan may be in a text format or another suitable format and may be accessed from the Response Plan input 612 of FIG. 6 as noted above. For example, the response plan on the school personnel communication device may be populated when the communication device is connected to the internet and/or the Response Plan input 608 is selected by the user. The response plan on the communication device may be compared to the latest version of the response plan stored on one or more computer servers in the alert center 102. If the response plan is not the latest version, a response plan stored in computer servers of the alert center 102 may be pulled into the communication device. If, however, the communication device does not have internet access, the school personnel communication device may display the previously loaded response plan, no response plan, etc. If no response plan has been loaded to the communication device, the software application may display a message indicating no response plan is available.

In other example embodiments, the school of FIG. 1 may enter a system testing mode to test its emergency response plan(s), messaging system, etc. For example, the school personnel SP software application may include a selectable input (e.g., the Test Alert input 610 of FIG. 6) to enter a system test without providing a notification to the alert center 102, LEO communication devices, etc. This testing mode option may be available only to particular school personnel SP (e.g., principals, etc.), a network of school personnel SP, all school personnel SP associated with a school, etc. In some embodiments, the testing mode may be coordinated with the alert center 102 and/or local law enforcement offices for system testing. As such, school personnel SP may become familiar with various user inputs, user interfaces, maps, audible sounds, notifications, response plans, etc. of the software application, communication connections (e.g., between the school and the alert center 102) may be tested, etc.

Figure 23:
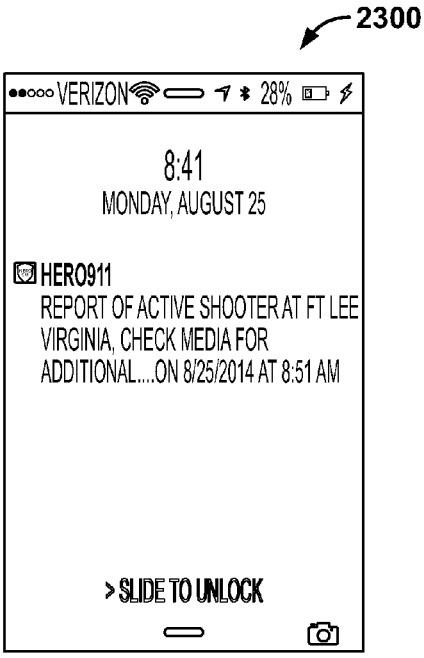
FIG. 23 is a screen shot of a LEO software application displaying an emergency alert with no selectable input to acknowledge the alert according to another example embodiment.

Referring back to FIG. 1, the alert center 102 may also send an emergency alert to LEO communication devices regardless of their location (e.g., outside the stationary geofence 104). The emergency alert may include an alert initiated from the school encompassed by the stationary geofence 106 and/or another alert initiated elsewhere. In such circumstances, the emergency alert may be for informational use only. For example, and with reference to FIG. 1, the one LEO determined to be outside the stationary geofence 104 may be restricted from acknowledging the received emergency alert. In such cases, the LEO software application may restrict user input acknowledging this emergency alert by, for example, not providing a selectable input or the like for acknowledging the alert. FIG. 23 illustrates one example screen shot 2300 of a LEO software application displaying an emergency alert with no selectable input for acknowledging the alert.

Figure 24:
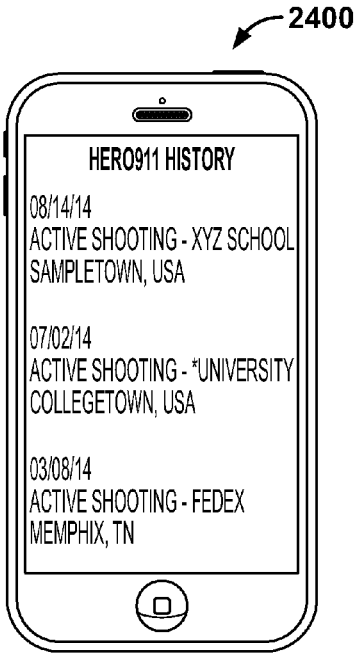
FIG. 24 is a screen shot of a LEO software application displaying a history of past alerts according to yet another example embodiment.

Additionally and/or alternatively, the alert center 102 may send past alerts to LEO communication devices regardless of their location (e.g., inside or outside the stationary geofence 104). The past alerts may include, for example, past emergency alerts, various messages, and/or other notifications. In other embodiments, the LEO communication device may be able to display previously received alerts stored in memory on that device. For example, FIG. 24 illustrates one example screen shot 2400 of a LEO software application displaying past alerts.

Figure 2:
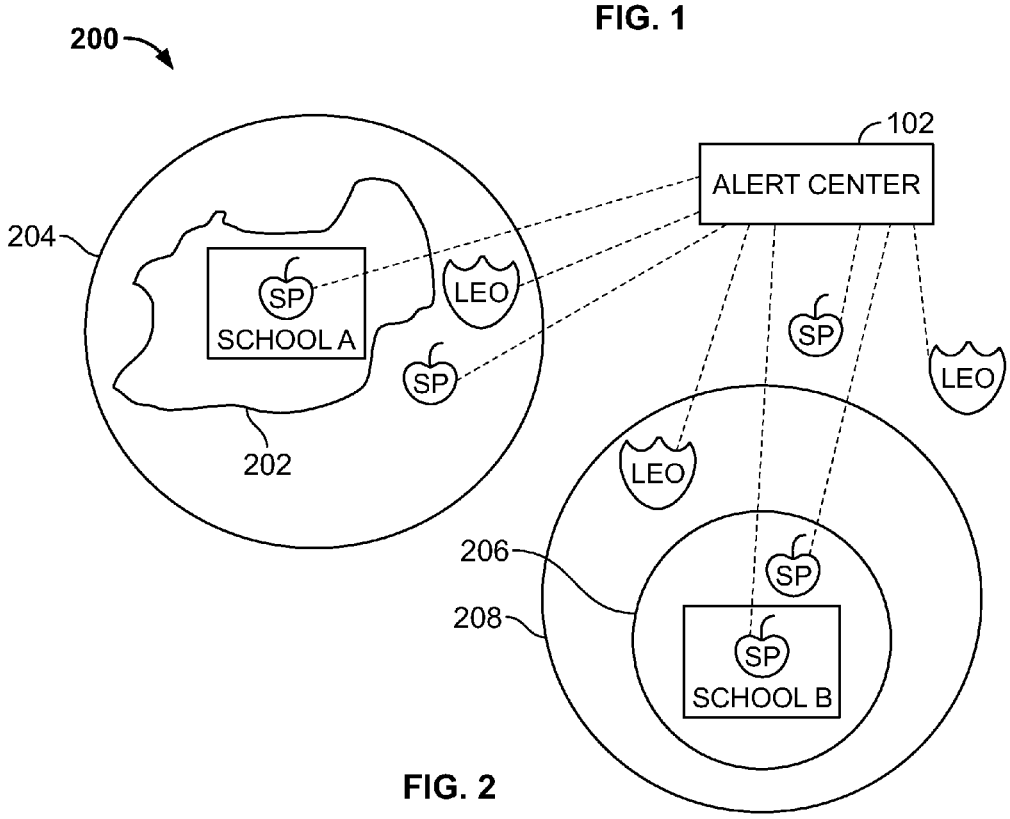
FIG. 2 is a diagram of a system including the alert center of FIG. 1, two stationary geofences encompassing a school, and two other stationary geofences encompassing another school according to another example embodiment.

Additionally, the alert center 102 of FIG. 1 may manage communications to and/or from school personnel SP and/or LEOs located within different stationary geofences. For example, FIG. 2 illustrates a system 200 including the alert center 102 of FIG. 1, four stationary geofences 202, 204, 206, 208 and two schools A, B. The alert center 102 and/or the communication devices used by the LEOs and/or the school personnel SP of FIG. 2 may include similar features as the alert center 102 and communication devices as described above with reference to FIG. 1.

As shown in FIG. 2, the stationary geofence 204 encompasses the stationary geofence 202 and both geofences 202, 204 encompass the school A. Similarly, the stationary geofence 208 encompasses the stationary geofence 206 and both geofences 206, 208 encompass the school B. Each stationary geofence 202, 204, 206, 208 may be different shapes and/or encompass different geographical areas. Alternatively, some of the stationary geofences 202, 204, 206, 208 may have the same shape and/or encompass common geographical areas (e.g., overlapping geofences).

In the example of FIG. 2, one LEO is within the stationary geofence 204 and one LEO is within the stationary geofence 208. Additionally, two LEOs are outside the stationary geofence 204 and two LEOs are outside the stationary geofence 208. Likewise, one school personnel SP is within the stationary geofence 202 and two school personnel SP are within the stationary geofence 206. Four school personnel SP are outside the stationary geofence 202 and three school personnel SP are outside the stationary geofence 206.

Because the alert center 102 is able to manage communications to and/or from school personnel SP and/or LEOs located within different stationary geofences, the system 200 is not location specific. For example, an LEO may be traveling across the country on vacation and enter and exit multiple geofences during this time. If the LEO is within the stationary geofence 204 (e.g., located in Missouri) when the alert center 102 is notified of an armed intruder within the stationary geofence 202 (e.g., a protection zone), the alert center 102 sends an emergency alert to that LEO corresponding to the notification. Additionally and/or alternatively, that same LEO may later be within the stationary geofence 208 (e.g., located in Florida). If the alert center 102 is notified of an armed intruder within the stationary geofence 206 (e.g., a different protection zone) while the LEO is within the stationary geofence 208, the alert center 102 provides an emergency alert to that LEO corresponding to the notification. Accordingly, one LEO may receive one emergency alert while in one geographical area and receive another emergency alert while in another geographical area.

In some example embodiments, the alert center 102 may provide a notification (e.g., the emergency alert, etc.) to school personnel (e.g., teachers, principals, deans, presidents, etc.) associated with other schools, members of a neighboring church, neighboring businesses, etc. This notification may include a description of the emergency alert (e.g., a school shooting, armed intruder, etc.), the name of the school affected, the elapsed time from when the original notification indicating the armed intruder situation was sent, etc. Thus, school personnel associated with another school and/or other neighboring personnel may be notified of a possible emergency and proceed with an appropriate response plan (e.g., lock down, evacuation, etc.).

Figure 3A:
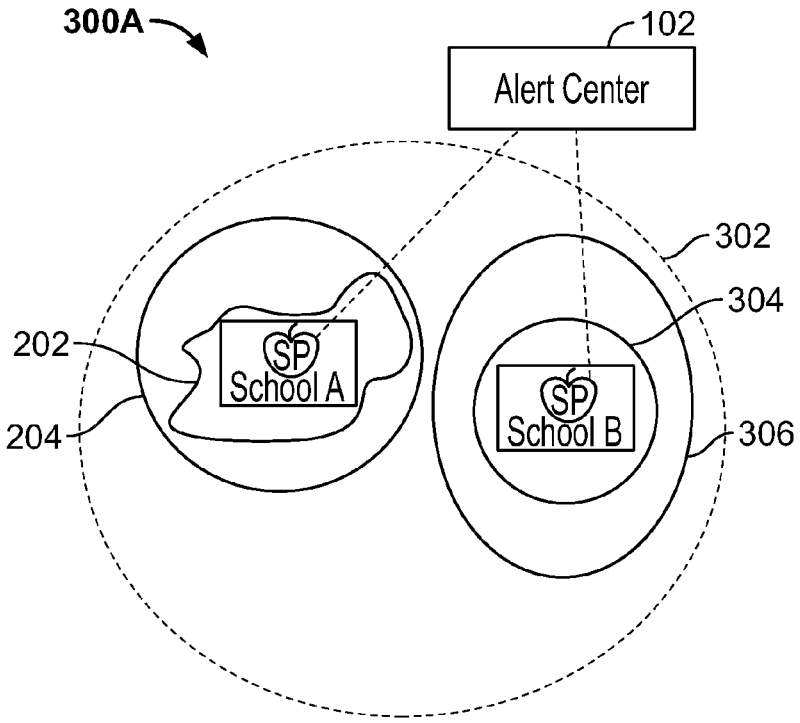
FIGS. 3A and 3B are diagrams of a system including the alert center of FIG. 1 and a stationary geofence encompassing two schools according to yet another example embodiment.

For example, FIG. 3A illustrates a system 300A including the alert center 102 of FIG. 1, a stationary geofence 302 encompassing the stationary geofences 202, 204 of FIG. 2 and stationary geofences 304, 306. The stationary geofences 202, 204 encompass school A and the stationary geofences 302, 306 encompass school B. Each school A, B includes one school personnel SP. Although not shown, the stationary geofences 202, 204, 302, 304, and/or 306 may encompass (e.g., at least periodically) various other communication devices used by businesses, other individuals (e.g., LEOs, members of a church, etc.), etc. The alert center 102, the communication devices used by the school personnel SP of FIG. 3A, and/or the various other communication devices encompassed by the stationary geofence 302 may include similar features as the alert center 102 and communication devices as described above with reference to FIGS. 1 and/or 2.

Although FIG. 3A illustrates the stationary geofence 302 as circular and encompassing the stationary geofences 202, 204, 304, 306, it should be apparent to those skilled in the art that the stationary geofence 302 may include other shapes and/or configurations without departing from the scope of the disclosure. For example, the stationary geofence 302 may be oval, rectangular, etc. In other embodiments, the stationary geofence 302 may be defined by various curved and/or straight lines.

If the alert center 102 of FIG. 3A receives a notification indicating an armed intruder situation from the school personnel SP located in school A, the alert center 102 may determine whether any other communication devices (e.g., a school personnel SP communication device, neighboring business communication device, etc.) are within the stationary geofence 302. After identifying the school personnel SP located in school B, the alert center 102 may provide the emergency alert to this school personnel's communication device in response to the initial notification. As such, school personnel SP associated with school B of FIG. 3A, neighboring businesses, etc. may prepare accordingly.

Figure 3B:
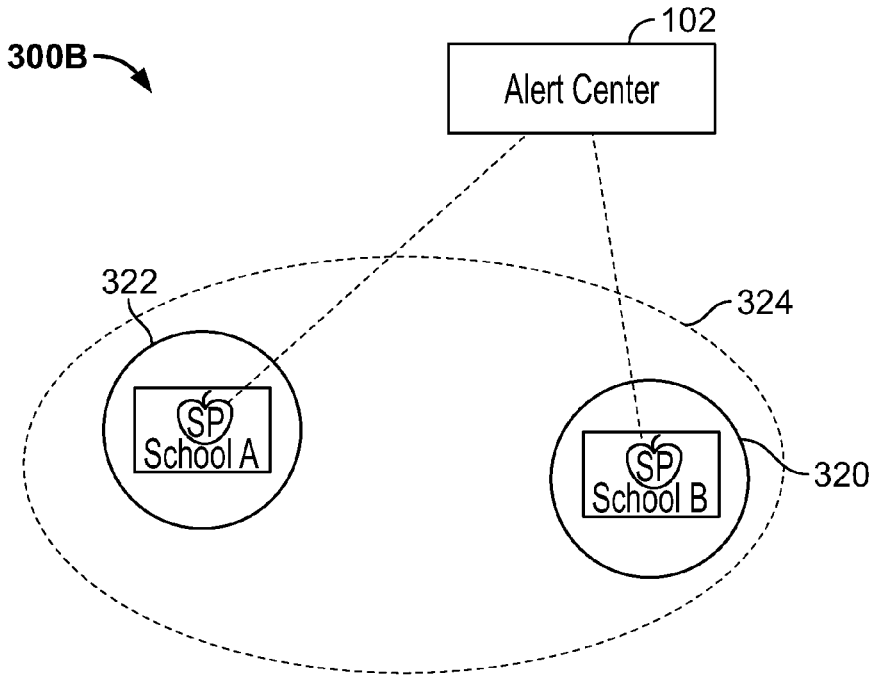

FIG. 3B illustrates another example system 300B including the alert center 102 of FIG. 1, a stationary geofence 322 encompassing school A, a stationary geofence 320 encompassing school B, and a stationary geofence 324 encompassing both stationary geofences 320, 322. Each school A, B includes one school personnel SP. Although not shown, the stationary geofences 320, 322, and/or 324 may encompass (e.g., at least periodically) various communication devices used by businesses, other individuals (e.g., LEOs, members of a church, etc.), etc. The alert center 102, the communication devices used by the school personnel SP of FIG. 3B, and/or the various other communication devices encompassed by the stationary geofence 324 may include similar features as the alert center 102 and communication devices as described above with reference to FIGS. 1 and/or 2.

After receiving a notification indicating an armed intruder situation from the school personnel SP located in school B, the alert center 102 of FIG. 3B may determine whether any other communication devices are within the stationary geofence 324 and then send the emergency alert to those other communication devices in response. For example, after receiving the notification from the school personnel SP located in school B, the alert center 102 may send the emergency alert to the school personnel SP communication device in school A.

Additionally, although FIGS. 3A and 3B illustrates specific stationary geofences encompassing other stationary geofences, it should be apparent to those skilled in the art that one or more stationary geofences may overlap any one or more other stationary geofences shown and/or other stationary geofences not shown.

Further, the size, shape, location, etc. of the stationary geofence 302 of FIG. 3A and/or stationary geofence 324 of FIG. 3B may be defined based on various factors including, for example, population size, population density, demographics, accessible roads, known emergency personnel (e.g., police stations, etc.) in the area, etc. For example, the particular circular stationary geofence 302 may have a radius of about five miles or another suitable distance.

The alert center 102 of FIGS. 1, 2 3A, and/or 3B may include a computer server (e.g., a remote server as shown in FIG. 1) to perform any one or more of the alert center features disclosed herein. Although FIG. 1 illustrates one computer server, it should be apparent to those skilled in the art that the alert center 102 may include more than one computer server to perform the alert center features.

For example, the computer server of FIG. 1 may include memory for storing computer-readable instructions for performing the methods described above and processor(s) for executing the computer-readable instructions. Additionally and/or alternatively, the computer-readable instructions for performing the methods may be stored on a non-transitory computer-readable medium including, for example, disks, SD cards, DVD, CD-ROMs, ROMs, RAMs, EPROMs, EEPROMs, DRAMs, VRAMs, flash memory devices, or any other suitable medium for storing instructions.

Figure 4:
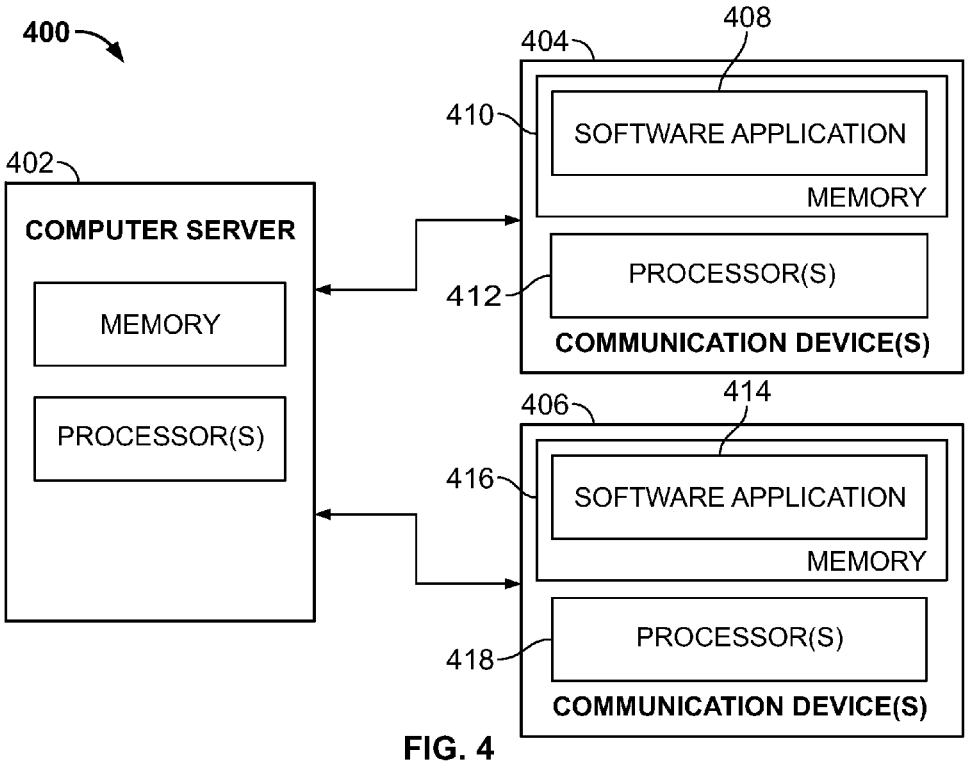
FIG. 4 is a block diagram of a system including a computer server and multiple communication devices according to another example embodiment.

FIG. 4 illustrates another example computer server that may be employed to perform any one or more of the alert center features explained herein. As shown in FIG. 4, an example system 400 includes the computer server 402 and communication devices 404, 406. The communication device 404 may be any of the school personnel's communication devices disclosed herein while the communication device 406 may be any of the LEO's communication device disclosed herein. Each communication device 404, 406 includes memory 410, 416, one or more processors 412, 418, and a software application 408, 414 stored in its respective memory 410, 416 for execution by its respective processors 412, 418.

In some embodiments, the LEO software application 414 is provided only to LEOs (e.g., previously verified LEOs, etc.). Thus, only LEOs may be grouped together to form an LEO network. Likewise, the school personnel software application 408 may be provided only to school personnel associated with a particular school, school system, etc.

As disclosed herein, an LEO may be any agent, employee, etc. of a government (e.g., federal, state, local including municipality, county, etc.), a reservation (e.g., Indian reservation, etc.), etc. who is legally authorized to carry a weapon. The LEO may be on-duty, off-duty, retired, etc. For example, LEOs may include federal police (e.g., CIA agents, FBI agents, secret service agents, ATF agents, border patrol, etc.), non-federal police (e.g., state, local, county, etc.), tribal agents, etc.

The communication devices disclosed herein may include any suitable communication device able to communicate via a communication network including, for example, smartphones, tablet computers, etc. Additionally, the communication devices may be mobile, fixed to a wall (or other structures), etc. For example, a school personnel communication device may be fixed (permanently or temporarily) to a wall in a school and accessible by appropriate school personnel SP. In addition, mobile communication devices (e.g., smartphones, etc.) as disclosed herein are presumed to be with an individual unless specified otherwise. As such, a location of an LEO and a location of a LEO communication device are presumed the same.

The LEO software applications and/or the school personnel software applications disclosed herein may be a mobile software application suitable for a communication device as described above. The software applications may be downloaded from an online application store including iTunes®, Android Market, etc. or any other suitable application store. Additionally, although the LEO software application screen shots and school personnel software application screen shots disclosed herein include particular user interfaces (e.g., input configurations, etc.), maps, etc., it should be apparent that any suitable user interface, map, etc. may be employed without departing from the scope of the disclosure.

Additionally, the communication(s) between the communication devices and the computer server(s), the alert centers, etc. may be a direct communication. For example, an LEO may communicate directly with a computer server via the software application of the LEO's communication device. Alternatively, the communication(s) between the communication devices and the computer server(s), the alert centers, etc. may not be a direct communication.

The stationary geofences disclosed herein may be a virtual perimeter for a geographic area. The stationary geofences may be any suitable shape (e.g., symmetrical or nonsymmetrical) including, for example, a circle, an oval, a square or any other polygon shape, etc. For example, a stationary geofence may cover only a school building, a user defined radius about the school building, etc. Additionally, the stationary geofences may include a geographic area in multiple states (e.g., bordering states), counties, etc. For example, a virtual perimeter of a stationary geofence may extend into Missouri and Kansas.

The stationary geofences may be created by global positioning coordinates based on global positioning systems (GPS). For example, the stationary geofences may be established by latitude(s), longitude(s), altitude(s), and/or a radius around a fixed location. Alternatively, the stationary geofences may be created by any other suitable mapping technique.

Although the FIGS. 1-3 illustrate a stationary geofence encompassing a school and communications devices used by school personnel, any one of the stationary geofences may encompass any other suitable premises including, for example, a business (e.g., a theater, a grocery store, etc.), a church, a park, etc. and any one of the communication devices may be used by personnel associated with that premises. For example, the stationary geofence 202 of FIG. 2 may encompass a church while the stationary geofence 206 of FIG. 2 may encompass a theater.

Additionally, it should apparent to those skilled in the art that a system (e.g., the systems, communication devices, computer servers, alert centers, etc. disclosed herein) may include and/or implement any one or more of the above described features without departing from the scope of the disclosure. For example, the systems disclosed herein may receive a notification indicating a system test without sending an emergency alert to the LEOs determined to be within a particular stationary geofence.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A computer-implemented method executed by one or more computer servers, the method comprising:

receiving a first notification from a first communication device of a first plurality of communication devices, wherein the first notification indicates whether an armed intruder is located within a first stationary geofence;

determining whether one or more law enforcement officer (LEO) communication devices are within a second stationary geofence different than the first stationary geofence; wherein the LEO communication devices comprise at least a first LEO communication device identifying a first law enforcement officer (LEO), and a second LEO communication device identifying a second law enforcement officer (LEO);

sending an emergency alert to the one or more LEO communication devices determined to be within the second stationary geofence; wherein either the first stationary geofence or the second stationary geofence or both are definable at a first stationary location and movable to a second stationary location;

receiving acknowledgement data from at least a first responding LEO communication device determined to be within the second stationary geofence; wherein the acknowledgement data is comprised of data indicating whether the responding LEO communication device identifies a uniformed LEO; and transmitting to each responding LEO communication device a set of first situational data; wherein the first situational data comprises data indicating the number of responding uniformed LEOs and data indicating the number of responding LEOs not in uniform.

2. The method of claim 1 further comprisin receiving an acknowledgement of the emergency alert from at least one or more LEO communication devices determined to be within the second stationary geofence, the acknowledgement including an indication of whether the acknowledging LEO is in uniform.

3. The method of claim 1 further comprising sending to each LEO communication device that acknowledged the emergency alert a quantity indicating the number of LEOs in uniform that acknowledged the emergency alert and a quantity indicating the number of LEOs not in uniform that acknowledged the emergency alert.

4. The method of claim 3 further comprising sending to each LEO communication device that acknowledged the emergency alert data indicating a location of each other acknowledging LEO in uniform and a location of each other acknowledging LEO not in uniform.

5. The method of claim 1 further comprising sending a response plan to at least one communication device of the first plurality of communication devices, the response plan including one or more suggested actions for responding to the emergency alert.

6. The method of claim 1 further comprising sending to each LEO communication device that acknowledged the emergency alert data indicating an approximate location of the first communication device.

7. The method of claim 6 further comprising sending to said each LEO communication device that acknowledged the emergency alert data indicating an associated tolerance of the approximate location.

8. The method of claim 1 where the notification is a first notification, the method further comprising receiving a second notification from at least one of the first plurality of communication devices, the second notification indicating a cancellation of the first notification.

9. The method of claim 1 further comprising sending a message to one or more of the first plurality of communication devices.

10. The method of claim 9 further comprising determining whether one or more of the first plurality of communication devices are within the first stationary geofence and wherein sending the message includes sending the message to the one or more of the first plurality of communication devices determined to be within the first stationary geofence.

11. The method of claim 1 further comprising determining whether one or more of the first plurality of communication devices are within a third stationary geofence different than the first stationary geofence, and in response to receiving the notification, sending the emergency alert to said one or more of the first plurality of communication devices determined to be within the third stationary geofence.

12. The method of claim 1 further comprising sending the emergency alert to LEO communication devices determined to be outside the second stationary geofence in response to the notification.

13. The method of claim 1 wherein the notification is a first notification, the method further comprising receiving a second notification from one of the first plurality of communication devices indicating a system test.

* * * * *